US011505388B2

(12) United States Patent
Stadel et al.

(10) Patent No.: US 11,505,388 B2
(45) Date of Patent: Nov. 22, 2022

(54) VACUUM-TIGHT PRESSURE RELIEF VALVE FOR PACKAGING CONTAINERS

(71) Applicant: Syntegon Technology GmbH, Waiblingen (DE)

(72) Inventors: Hans-Peter Stadel, Lorch (DE); Herbert Stotkiewitz, Bietigheim-Bissingen (DE); Jenny Haase, Allmersbach (DE)

(73) Assignee: SYNTEGON TECHNOLOGY GMBH, Waiblingen (DE)

( * ) Notice: Subject to any disclaimer, the term of this patent is extended or adjusted under 35 U.S.C. 154(b) by 0 days.

(21) Appl. No.: 16/580,086

(22) Filed: Sep. 24, 2019

(65) Prior Publication Data

US 2020/0239213 A1 Jul. 30, 2020

(30) Foreign Application Priority Data

Jan. 24, 2019 (DE) ..... 102019200867.4

(51) Int. Cl.
*B65D 77/22* (2006.01)

(52) U.S. Cl.
CPC ..... *B65D 77/225* (2013.01)

(58) Field of Classification Search
CPC ... B65D 77/225; B65D 51/1644; F16K 15/14; F16K 15/141
See application file for complete search history.

(56) References Cited

U.S. PATENT DOCUMENTS 2,223,944 A * 12/1940 Roy ..... F16K 15/02 137/517
4,420,015 A * 12/1983 Blaser ..... B65D 77/225 137/852

(Continued)

FOREIGN PATENT DOCUMENTS

DE 2603712 A1 8/1977
DE 2549855 A1 9/1977

(Continued)

OTHER PUBLICATIONS

Machine translation of DE2603712A1 (Year: 1977).*

(Continued)

*Primary Examiner* — Michael R Reid
(74) *Attorney, Agent, or Firm* — Michael Best & Friedrich LLP

(57) ABSTRACT

A pressure relief valve (1) comprises a main body (2), at least one through opening (51), which extends through the main body (2), a diaphragm (6), which is arranged over the at least one through opening (51), and a fluid (8), which is provided on the main body (2), the fluid (8) being arranged between the diaphragm (6) and the main body (2), the main body (2) having a first sealing region (21), a second sealing region (22) radially outside the first region, and a third sealing region (23) radially outside the second region, the regions being respectively formed as continuously closed, the at least one through opening (51) being arranged between the first sealing region (21) and the second sealing region (22), and the diaphragm (6) covering the first sealing region (21), the second sealing region (22) and the third sealing region (23).

19 Claims, 3 Drawing Sheets

(56) References Cited

U.S. PATENT DOCUMENTS

| | | | | |
|---|---|---|---|---|
| 4,444,219 | A * | 4/1984 | Hollenstein | B65D 77/225 137/246 |
| 7,243,683 | B2 * | 7/2007 | Stotkiewitz | B65D 77/225 137/859 |
| 7,721,752 | B2 * | 5/2010 | Stotkiewitz | B65D 77/225 137/246 |
| 8,555,925 | B2 * | 10/2013 | Stadel | B65D 77/225 137/843 |
| 2012/0042975 | A1 * | 2/2012 | Stotkiewitz | F16K 17/18 137/843 |
| 2012/0048853 | A1 | 3/2012 | Stadel et al. | |

FOREIGN PATENT DOCUMENTS

| | | |
|---|---|---|
| DE | 19843430 A1 | 3/2000 |
| EP | 2396244 | 6/2013 |

OTHER PUBLICATIONS

European Patent Office Extended Search Report for Application No. 19197908.7 dated Mar. 30, 2020 (9 pages including English translation).

* cited by examiner

II-II

VACUUM-TIGHT PRESSURE RELIEF VALVE FOR PACKAGING CONTAINERS

BACKGROUND OF THE INVENTION

The present invention relates to a pressure relief valve of a packaging container and to a packaging container.

It is known for pressure relief valves to be used for packaging containers that are used for packaging a product with which they are filled. The pressure relief valve allows gases occurring within the packaging to be let out of the packaging container. The necessity of such a possibility for gas to escape from the packaging container arises for example in the case of a filled product that still gives off gas even after being packed, and thereby allows a positive pressure to be produced in the packaging container. However, at the same time penetration of air, in particular oxygen present in the air, has to be avoided in order to maintain a quality of the filled product. A pressure relief valve used for this is disclosed for example by EP 2 396 244 B1.

SUMMARY OF THE INVENTION

Against this background, the pressure relief valve according to the invention of a packaging container offers the advantage of improved sealing of the packaging container. In this case, reliable sealing of the packaging container with respect to the surroundings when there is a vacuum or a strong negative pressure in the interior of the packaging container is especially possible. The pressure relief valve according to the invention allows a low negative pressure to be maintained in the packaging container over a particularly long period of time. This is achieved according to the invention by the pressure relief valve comprising a main body, at least one through opening, a diaphragm and a fluid. The main body is in this case formed in particular concentrically in relation to a central axis. The through opening extends completely through the main body and allows gas to pass through the main body. The diaphragm is arranged over the through opening and covers it completely. Furthermore, the fluid is provided on the main body and is arranged between the diaphragm and the main body. The fluid in this case has the effect that the diaphragm is held on the main body by adhesion. Moreover, the fluid is uniformly distributed between the main body and the diaphragm on the basis of the capillary effect. The diaphragm is in particular formed from a flexible material.

Furthermore, the main body has a first sealing region, a second sealing region and a third sealing region. Each of these three sealing regions is respectively formed as continuously closed. In this case, the second sealing region is arranged radially inside the third sealing region and the first sealing region is arranged radially inside the second sealing region. The radial direction is in this case viewed with respect to the central axis of the main body.

The at least one through opening is arranged between the first sealing region and the second sealing region in the radial direction. The first sealing region, the second sealing region and the third sealing region are in this case respectively covered by the diaphragm.

The specific configuration of the pressure relief valve with the three sealing regions and the arrangement of the through opening between the first sealing region and the second sealing region have the effect of achieving particularly good and durable sealing of the pressure relief valve under vacuum loading. The configuration according to the invention of the pressure relief valve allows the vacuum in the interior of the packaging container to be maintained particularly reliably over a long period of time in a sealed state of the pressure relief valve. The sealed state in this case describes a state of the pressure relief valve when there is a vacuum or negative pressure in the interior of the packaging container, it not being possible for gas to escape through the pressure relief valve. In the sealed state, the diaphragm is resting respectively against the first sealing region and against the second sealing region, and thereby prevents gas from being able to pass via the through opening into the interior of the packaging container, in that a possible passage from the surroundings to the through opening is completely closed off by the diaphragm. The stronger the pressure difference across the pressure relief valve is, the stronger the diaphragm is in this case pressed against the first sealing region and the second sealing region, whereby the sealing effect is further increased.

If the vacuum or the negative pressure in the interior of the packaging container is ended, for example by gas developing in the interior of the packaging container, which can be caused by the product with which the package is filled giving off gas, the diaphragm can lift off slightly from the first sealing region and the second sealing region. The adhesion caused by the fluid that is present has the effect that the diaphragm is still held on the main body, at least until a pressure in the interior of the packaging container has reached a level of the pressure in the surroundings. Interaction of the diaphragm and the fluid in this case also prevents air from the surroundings from being able to penetrate into the packaging container. Such a state of equilibrium, in which the pressure in the interior of the packaging container is approximately equal to the pressure in the surroundings, is also referred to as an inactive state. In the inactive state, there is consequently a certain distance between the diaphragm and the first sealing region and the second sealing region respectively.

If the pressure in the interior of the packaging container continues to increase above the level of the pressure in the surroundings, the pressure relief valve makes it possible that gases can escape from the packaging container, so that a positive pressure with respect to the surroundings is reduced. In this case, in the fluid there forms a gas channel, which extends through the fluid from the through opening and slightly raises the diaphragm. Through this gas channel, the gas can flow out into the surroundings, whereby a pressure equalization is brought about. As soon as the difference in pressure between the packaging container and the surroundings goes below a certain value again, the first diaphragm is drawn back again in the direction of the sealing regions by the adhesive force of the fluid and the gas channel is closed, so that the pressure relief valve provides a sealed closure again.

Preferably, precisely two through openings are provided, lying opposite one another with respect to a central axis of the main body.

It is preferred that the first sealing region, the second sealing region and the third sealing region are respectively formed in a ring-shaped manner. Furthermore, the three sealing regions are respectively formed concentrically in relation to one another. It is particularly advantageous in this case if the three sealing regions are respectively formed concentrically in relation to the central axis of the main body. This not only provides a geometry of the main body that is particularly easy to produce, but also achieves the effect that the diaphragm can rest against the sealing regions in a particularly favorable symmetrical manner in the sealed state, which has particularly advantageous effects on good and reliable sealing of the pressure relief valve.

It is particularly preferred that the first sealing region is formed in the form of a circular ring area. That is to say that the first sealing region forms a sealing area in the form of a circular ring against which the diaphragm can be made to rest. The circular ring area in this case lies in particular in a plane which is perpendicular to the central axis of the main body. In particular if the diaphragm has a certain flexibility, an area contact between the first sealing region and the diaphragm is thereby obtained in the sealed state. As a result, a larger sealing area is available to achieve an optimum sealing effect of the pressure relief valve.

It is also advantageous if the second sealing region is formed in the form of a circular line. In this case, the second sealing region forms a sealing area in the form of a circular line against which the diaphragm can be made to rest. The circular line in this case lies in particular in a plane which is perpendicular to the central axis of the main body. In the sealed state, a line contact between the second sealing region and the diaphragm is thereby obtained. In particular if the diaphragm has a certain flexibility, a second sealing region formed in such a way can be pressed slightly into the diaphragm by the pressing force resulting from the difference in pressure, whereby the pressure relief valve continues to allow particularly good and reliable sealing.

It is particularly preferred that the first sealing region and the second sealing regions lie in a common sealing plane. The sealing plane in this case lies in particular perpendicularly to the central axis of the main body. Consequently, in the sealed state the diaphragm can come to rest uniformly against both the first sealing region and the second sealing region, in order to ensure optimum sealing of the pressure relief valve.

Preferably, the third sealing region is formed in the form of a cone envelope ring. A distance that exists between the third sealing region and the diaphragm in an inactive state in this case increases radially inward. That is to say that the third sealing region is formed in a funnel-shaped manner and, when the three sealing regions are viewed from above, has its lowest point on its radially inner side. Furthermore, the third sealing region is formed such that it intersects the common sealing plane in which the first sealing region and the second sealing region lie. That is to say that the radially inner end of the third sealing region lies below the sealing plane. In particular, the third sealing region intersects the common sealing plane such that a radially inner third of an area of the third sealing region lies below the sealing plane. Consequently, in the sealed state the diaphragm does not lie against the radially inner end of the third sealing region but against a partial region of the third sealing region that lies radially further outward, in particular radially outside the radially inner third of the area of the third sealing region. This encourages the sealing of the pressure relief valve to take place primarily by means of the first sealing region and the second sealing region, in order to achieve particularly specific and optimum sealing of the pressure relief valve.

It is preferred that the cone envelope ring has a cone envelope base angle of between 1° and 4°. It is particularly preferred that the cone envelope base angle is 2.57°. Consequently, the pressure relief valve can be produced easily and at low cost, and distribution of the fluid such that it is especially present at the radially inner region of the main body is encouraged. Furthermore, as a result the adhesion of the diaphragm on the main body brought about by the fluid is optimized.

It is particularly advantageous if a first peripheral depression is formed between the first sealing region and the second sealing region. Furthermore, a second peripheral depression is formed between the second sealing region and the third sealing region. The through opening in this case opens out in particular into the first depression. As a result, the first sealing region and the second sealing region are formed as particularly distinctly raised, in order to make it easier for the diaphragm to come to rest in the sealed state to achieve particularly good sealing. Moreover, the first depression and the second depression may act as a reservoir for the fluid.

It is particularly preferred that the first depression and the second depression respectively have a depth, starting from the sealing plane. That is to say that the first depression and the second depression have an identical depth. Consequently, uniform conditions between the diaphragm and the two depressions prevail, whereby uniform resting of the diaphragm respectively against the first sealing region and against the second sealing region is encouraged. It is particularly favorable in this case if the first depression and the second depression have an identical volume content. Alternatively, the second depression may advantageously have a volume content that is smaller by 5% to 10% in comparison with the first depression.

It is also preferred that a radially inner edge of the third sealing region is arranged at a distance from the common sealing plane. In this case, a ratio of the distance to the depth of the two depressions is between 0.1 and 0.2. It is particularly preferred that the ratio is 0.15. Such relative sizes have a particularly favorable effect on optimum sealing and also on an optimum opening and closing behavior of the pressure relief valve.

Preferably, a third depression is formed radially inside the first sealing region. The third depression advantageously has in this case a rectangular cross section when viewed in a radial section. That is to say that the third depression is in particular formed centrally in the main body as a cylindrical blind hole. Such a third depression may furthermore serve as a reservoir for the fluid and further encourage defined resting of the diaphragm against the first sealing region.

It is preferred that the main body is an injection-molded part. It is particularly preferred that the main body is formed from a plastic. Consequently, the main body can be produced particularly easily and at low cost, it being possible for the geometry of the main body to be of a simple and flexible design.

Furthermore, it is advantageous if the main body has a round cross-sectional form. Consequently, the pressure relief valve can be produced easily and at low cost and a uniform distribution of the fluid is encouraged by the capillary effect.

It is particularly favorable if the main body also has a peripheral border region. The border region in this case defines a receiving space of the main body, within which the diaphragm and the fluid are received. It is preferred that the border region can be connected in a sealing manner to an inner side of a wall of the packaging container. It is particularly favorable in this case if the diaphragm has an outside diameter which substantially corresponds to an inside diameter of the border region or is slightly smaller. Preferably, at least one hole through which gas can flow from the surroundings into the receiving space and vice versa is formed in a region of the wall of the packaging container that is enclosed by the border region.

It is preferred that the border region has an annular projection protruding radially inward from the border region. The annular projection is in this case arranged on a side of the diaphragm opposite from the sealing regions. The annular projection has an inside diameter which is smaller than the outside diameter of the diaphragm. As a result, the annular projection restricts an axial movement of the diaphragm, and in particular prevents the diaphragm from falling out of the receiving space of the main body.

The invention also relates to a packaging container which comprises at least one pressure relief valve according to the invention. The packaging container may for example be used for packaging foodstuffs. It is particularly favorable if the packaging container is an aroma protection packaging for coffee. The packaging container with the pressure relief valve according to the invention allows products, such as for example coffee, to be packed in an airtight manner and in a vacuum, it being possible for the vacuum to be maintained in the interior of the packaging over a particularly long period of time. Moreover, a positive pressure produced in the interior of the packaging container by the products letting out gas can be reliably equalized by means of the pressure relief valve. In this case, especially penetration of oxygen into the closed packaging container is also reliably prevented by the pressure relief valve.

BRIEF DESCRIPTION OF THE DRAWINGS

The invention is described below on the basis of an exemplary embodiment in conjunction with the figures. In the figures, components that are functionally the same are respectively indicated by the same designations

DETAILED DESCRIPTION

Figure 1:
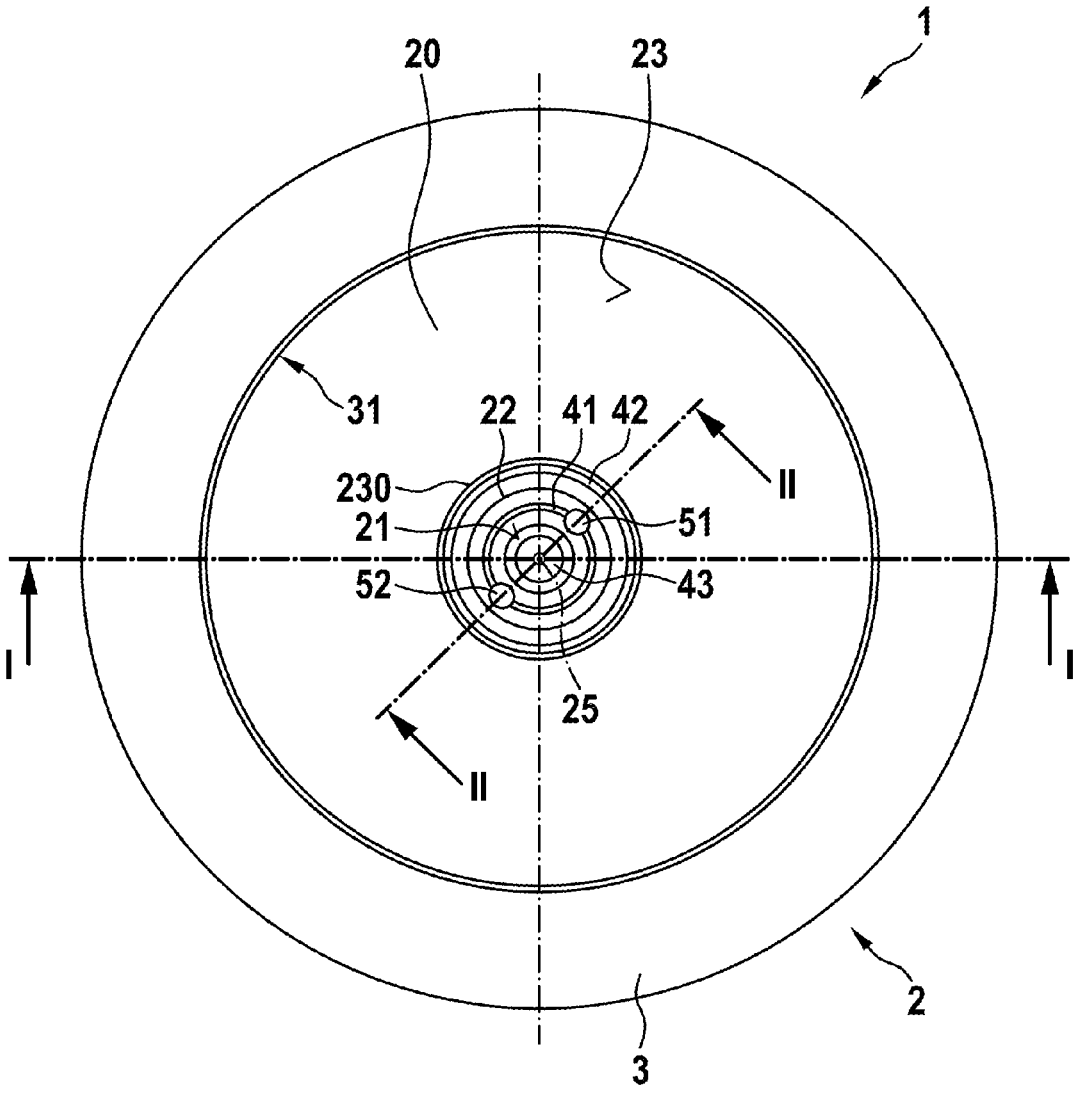
FIG. 1 shows a simplified schematic view of a pressure relief valve according to a preferred exemplary embodiment of the invention.
Figure 2:
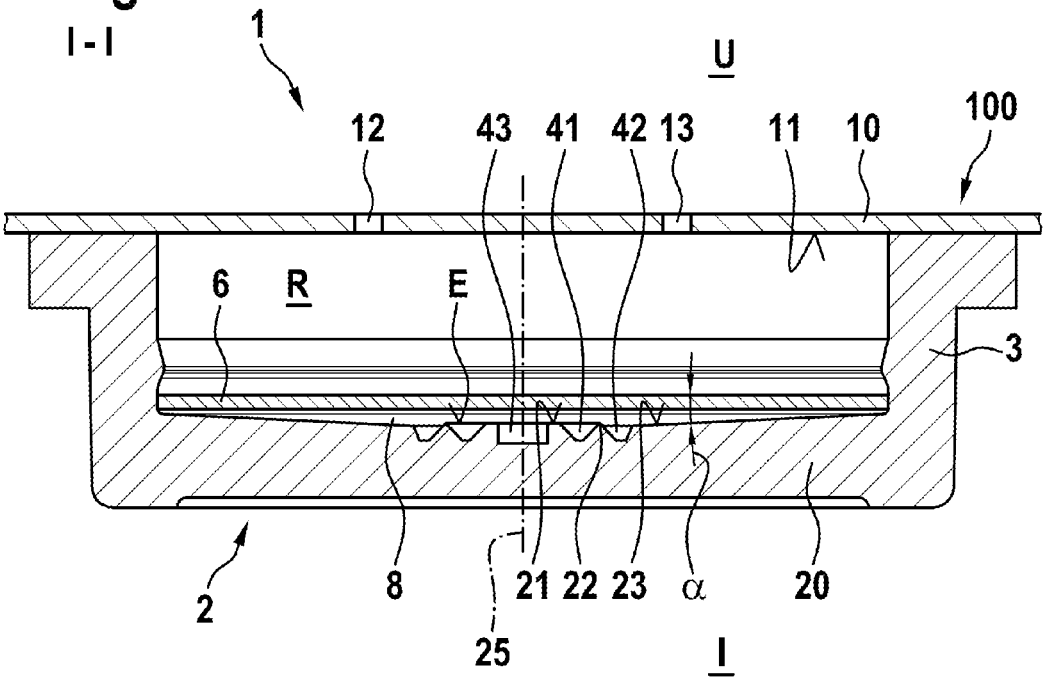
FIG. 2 shows a sectional view of the pressure relief valve of FIG. 1 along the line I-I.

FIGS. 1 and 2 show simplified schematic views of a pressure relief valve 1 according to a preferred exemplary embodiment of the invention. FIG. 1 shows in this case a plan view and FIG. 2 shows a sectional view I-I of the pressure relief valve 1.

The pressure relief valve 1 is connected to a wall 10 of a closed packaging container 100, for reasons of clarity the packaging container 100 and a diaphragm 6 of the pressure relief valve 1 not being depicted in FIG. 1 and only a small section of the wall 10 of the packaging container 100 being shown in FIG. 2. The pressure relief valve 1 is in this case fastened to a side 11 of the wall 10 that is facing an interior space I of the packaging container 100.

The packaging container 100 may be used for packaging products with which it is filled, such as a wide variety of foodstuffs. For example, such a packaging container 100 is suitable as aroma protection packaging for coffee. The pressure relief valve 1 according to the invention in this case achieves the effect that penetration of air into the interior space I of the packaging container 100 is prevented, while in the opposite direction gases can escape from the interior space I of the packaging container 100 into a surrounding area U. Such sealing of the packaging container 100 with at the same time the possibility of equalizing a positive pressure is possible particularly advantageously by the pressure relief valve 1. The pressure relief valve 1 is especially suitable for maintaining a vacuum or a strong negative pressure in the interior space I of the packaging container 100 over a long period of time. If, however, a positive pressure in comparison with the surroundings U occurs due to the product with which the package is filled letting out gas in the interior space I, the pressure relief valve 1 allows gases to escape from the interior space I of the packaging container 100 into the surroundings U. For this, two holes 12, 13, which respectively extend through the wall 10, are formed in the wall 10 of the packaging container 100.

The precise configuration of the pressure relief valve 1 is described in more detail below with reference to FIGS. 1 to 3.

The pressure relief valve 1 comprises a main body 2 and a diaphragm 6. The main body 2 is in this case formed in a pot-shaped manner and substantially concentrically in relation to a central axis 25.

The main body 2 has a base region 20, which is adjoined by an annular border region 3. At an end opposite from the base region 20, the border region 3 is connected to the wall 10 of the packaging container 100. The connection between the border region 3 and the wall 10 is an ultrasonic bond. Consequently, a receiving space R of the main body 2 is enclosed by the base region 20, the border region 3 and the wall 10.

The diaphragm 6 is arranged within the receiving space R. The diagram 6 is formed as a circular film disk of a flexible material and has an outside diameter which corresponds to an inside diameter of the border region 3. As can be seen in FIG. 2, the border region 3 also has an annular projection 31, which protrudes radially inward. The annular projection 31 restricts a mobility of the diaphragm 6 along the central axis 25.

In order to allow sealing of the pressure relief valve 1, especially under vacuum loading, the main body 2 also has a first sealing region 21, a second sealing region 22 and a third sealing region 23. As can be seen in FIG. 1, the first sealing region 21, the second sealing region 22 and the third sealing region 23 are respectively formed in a ring-shaped and continuously closed manner and concentrically in relation to one another.

Figure 3:
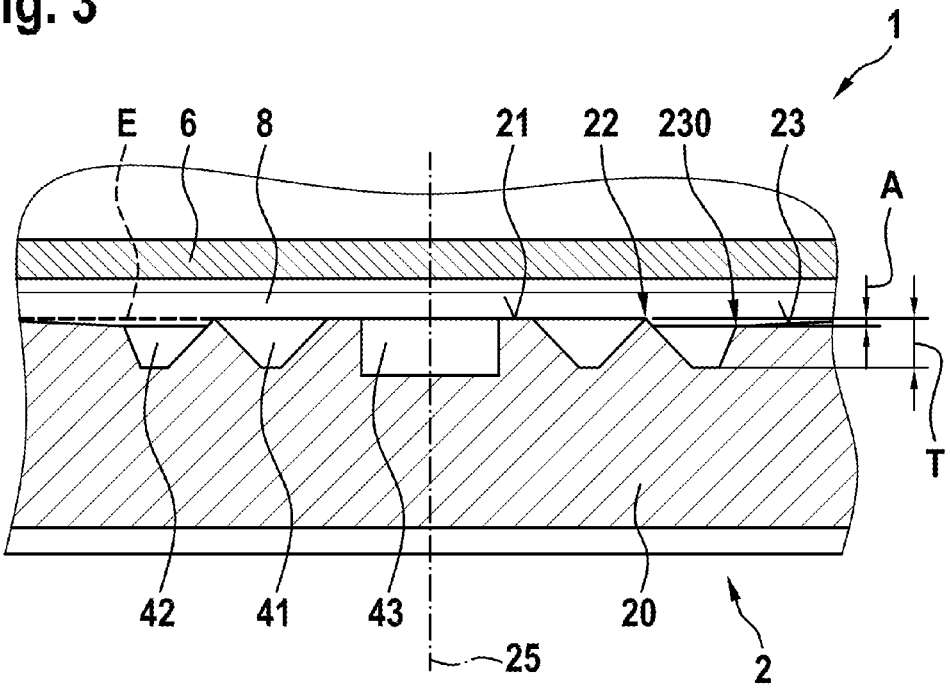
FIG. 3 shows a detail of FIG. 2.

The more precise arrangement, form and dimensions of the sealing regions 21, 22, 23 can be seen better in the sectional view in FIG. 2, and in particular in the detail represented in FIG. 3.

The first sealing region 21 is formed in the form of a circular ring area, which lies in a sealing plane E. The sealing plane E is in this case arranged perpendicularly to the central axis 25. Also, the second sealing region 22 is formed in the form of a circular line and is arranged radially outside the first sealing region 21. The second sealing region 22 likewise lies in the sealing plane E.

Furthermore, the third sealing region 23 is formed in the form of a cone envelope ring. The third sealing region 23 in this case intersects the sealing plane E. A cone envelope base angle $\alpha$ between the cone envelope ring and the sealing plane E is in this case 2.57° (cf. FIG. 2). As can also be seen in FIG. 3, as a result a radially inner edge 230 of the third sealing region 23 is arranged at a distance A below the sealing plane E.

A first peripheral depression 41 is also formed in the main body 2 between the first sealing region 21 and the second sealing region 22. In cross section, the first depression has the form of a symmetrical trapezoid. Furthermore, a second peripheral depression 42 is formed between the second sealing region 22 and the third sealing region 23. The second depression 42 has in cross section the form of a trapezoid. The first depression 41 and the second depression 42 respectively have a depth T, starting from the sealing plane E. A ratio of the distance A to the depth T is in this case 0.15.

Furthermore, a third depression 43 is formed radially inside the first sealing region 21. When viewed in cross section, the third depression 43 has the form of a rectangle or, since it is arranged centrally, is formed as a blind hole.

Figure 4:
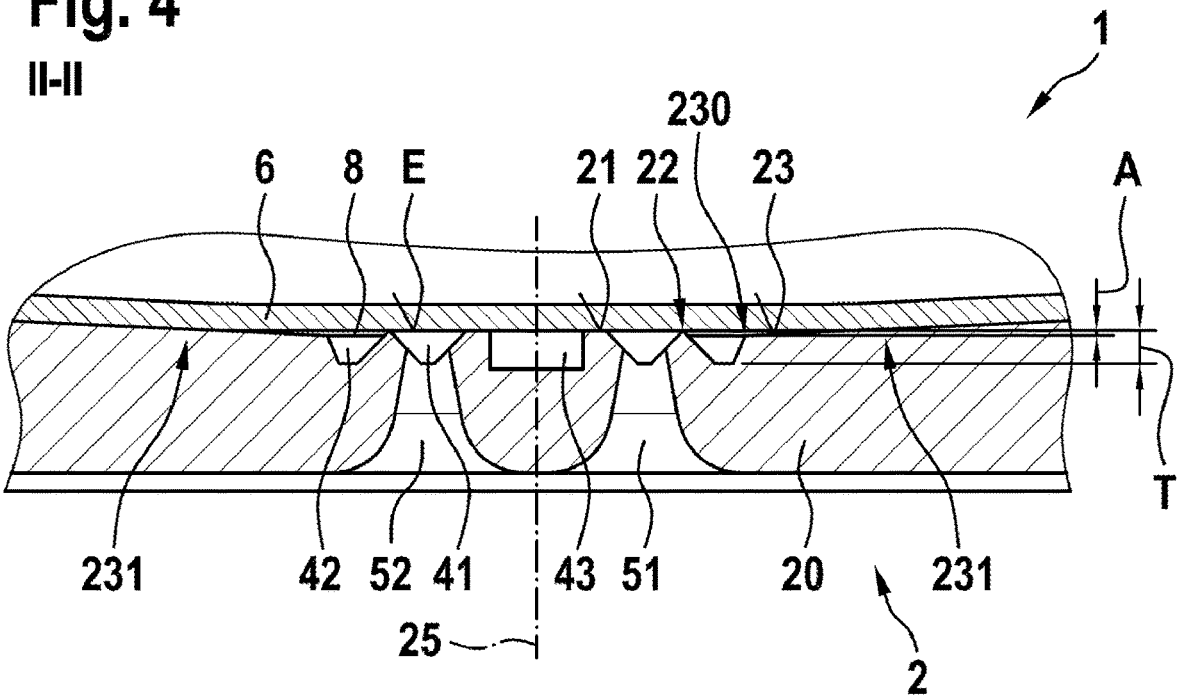
FIG. 4 shows a detail of a further sectional view of the pressure relief valve of FIG. 1 along the line II-II, the pressure relief valve being in a sealed state.

FIG. 4 shows a detail of a further sectional view II-II of the pressure relief valve of FIG. 1. As can be seen in FIG. 4, formed in the main body 2 are two through openings 51, 52, which respectively extend through the base region 20 of the main body 2 and are arranged substantially parallel to the central axis 25. The two through openings 51, 52 are respectively arranged between the first sealing region 21 and the second sealing region 22 and respectively open out into the first depression 41. Moreover, the two through openings 51, 52 are formed eccentrically and symmetrically in relation to the central axis 25 of the main body 2, as can also be seen in the plan view in FIG. 1. The two through openings 51, 52 are formed in cross section in a trumpet-shaped manner, which has particularly favorable effects on the one hand on the production of the main body 2, and on the other hand on the flow conditions during an outflow of gas. In this case, the through openings 51, 52 taper in the direction of the diaphragm 6.

Furthermore, a fluid 8, which here is a silicone oil, is provided on the base region 20. By means of the fluid 8, the diaphragm 6 is held on the base region 20. As a result of the capillary effect, the fluid 8 is distributed uniformly between the diaphragm 6 and the base region 20. By adhesion in between, the fluid 8 in this case ensures that the diaphragm 6 is held on the base region 20 by means of an adhesive force.

The way in which the pressure relief valve 1 functions is described below.

FIGS. 2 and 3 show in this case an inactive state of the pressure relief valve 1, that is to say when substantially the same pressure prevails between the interior space I and the surroundings U, and consequently no force is exerted on the diaphragm 6. In this inactive state, the diaphragm 6 is undeformed, and consequently completely parallel to the sealing plane E. The fluid 8 has the effect in this case of already preventing in this inactive state air from the surroundings U from being able to penetrate into the interior space I.

FIG. 4 shows a sealed state of the pressure relief valve 1. This sealed state exists whenever there is a pressure gradient between the surroundings U and the interior space I, that is to say whenever a vacuum or at least a negative pressure with respect to the surroundings U prevails in the interior space I. This pressure gradient brings about a force on the diaphragm 6, which presses the diaphragm 6 in the direction of the sealing regions 21, 22, 23. In this case, the diaphragm 6 is made to rest against all three sealing regions 21, 22, 23. In this case, there is surface-area contact between the first sealing region 21 and the diaphragm 6. The second sealing region 22 and the diaphragm are in linear contact. The arrangement of the third sealing region 23 in such a way that the radially inner edge 230 lies at a distance A below the sealing plane E has the effect that the sealing region 23 and the diaphragm 6 are not in contact in the region of the edge 230, but only radially further outside the contact point 231. This contact point 231 lies outside the radially inner third of the area of the third sealing region 23. This makes it possible that the diaphragm 6 is in each case pressed strongly against the first sealing region 21 and against the second sealing region 22, in order to ensure particularly good and reliable sealing of the through openings 51, 52. Since furthermore the diagram 6 is formed from a material with a certain flexibility, the first sealing region 21 and the second sealing region 22 can be pressed slightly into the diaphragm 6, which further encourages a particularly good sealing effect. Consequently, penetration of air into the interior space I of the packaging container 100 is prevented particularly efficiently, since the diaphragm 6 of the pressure relief valve 1 closes off the through openings 51, 52 particularly well as a result of the specific configuration of the sealing regions 21, 22, 23. The pressure relief valve 1 consequently allows the vacuum in the interior space I of the packaging container 100 to be maintained over a particularly long period of time.

However, a vacuum in the interior space I of the packaging container 100 may be ended by packed products giving off gas. Furthermore, if the products give off a great amount of gas, a positive pressure may occur in the interior space I with respect to the surroundings U. If there is such a positive pressure in the interior space I, the gas occurring can flow out through the pressure relief valve 1 to the outside into the surroundings U. For this, in the pressure relief valve 1 there forms a gas channel, which extends from one or both of the through openings 51, 52 through the fluid 8, and thereby slightly raises the diaphragm 6 at its border. Through this gas channel and via the holes 12, 13 in the package, the gas can flow out into the surroundings U, whereby a pressure equalization is brought about.

As soon as the pressure is sufficiently equalized, the gas channel through the fluid 8 is closed again and the diaphragm 6 is drawn back again in the direction of the sealing regions 21, 22, 23 by the adhesive force of the fluid 8, so that the pressure relief valve 1 provides a seal again.

The invention claimed is:

1. A pressure relief valve embodied free of springs and configured to be fastened on a packaging container, the pressure relief valve comprising:

a main body (2), at least one through opening (51), which extends through the main body (2), a diaphragm (6), which is arranged over the at least one through opening (51), and a fluid (8), which is provided on the main body (2), the fluid (8) being arranged between the diaphragm (6) and the main body (2), and the fluid (8) having the effect that the diaphragm (6) is held on the main body (2) by adhesion, the main body (2) having a first sealing region (21), a second sealing region (22) and a third sealing region (23), the first sealing region (21), the second sealing region (22) and the third sealing region (23) being respectively formed as continuously closed, the second sealing region (22) being arranged radially inside the third sealing region (23), the first sealing region (21) being arranged radially inside the second sealing region (22), the at least one through opening (51) being arranged between the first sealing region (21) and the second sealing region (22), and the diaphragm (6) covering the first sealing region (21), the second sealing region (22) and the third sealing region (23), wherein, starting from a central axis (25) of the main body (2) and viewed along a direction perpendicular to the central axis (25), the at least one through opening (51) is arranged between a radially outer edge of the first sealing region (21) and a radially inner edge of the second sealing region (22), wherein the third sealing region (23) is formed in the form of a cone envelope ring, and wherein the first sealing region (21) and the second sealing region (22) respectively lie in a common sealing plane (E) perpendicular to the central axis (25) of the main body (2).

2. The pressure relief valve according to claim 1, the first sealing region (21), the second sealing region (22) and the third sealing region (23) being respectively formed in a ring-shaped manner and concentrically in relation to one another.

3. The pressure relief valve according to claim 1, the first sealing region (21) being in the form of a circular ring area.

4. The pressure relief valve according to claim 1, the second sealing region (22) being in the form of a circular line.

5. The pressure relief valve according to claim 1, wherein a distance (A) between the third sealing region (23) and the diaphragm (6) in an inactive state increases radially inward, and wherein the third sealing region (23) intersects the sealing plane (E).

6. The pressure relief valve according to claim 5, the cone envelope ring having a cone envelope base angle ($\alpha$) of between 1° and 4° with respect to the sealing plane (E).

7. The pressure relief valve according to claim 1, a first peripheral depression (41) being formed between the first sealing region (21) and the second sealing region (22), and a second peripheral depression (42) being formed between the second sealing region (22) and the third sealing region (23).

8. The pressure relief valve according to claim 7, the first depression (41) and the second depression (42) respectively having a depth (T), starting from the sealing plane (E).

9. The pressure relief valve according to claim 8, a radially inner edge (230) of the third sealing region (23) being arranged at a distance (A) from the sealing plane (E), and a ratio of the distance (A) to the depth (T) being between 0.1 and 0.2.

10. The pressure relief valve according to claim 7, a third depression (43) being formed radially inside the first sealing region (21), and the third depression (43) having a rectangular cross section.

11. The pressure relief valve according to claim 1, the main body (2) being an injection-molded part.

12. The pressure relief valve according to claim 1, the main body (2) also having a peripheral border region (3), which defines a receiving space (R) on the main body (2).

13. The pressure relief valve according to claim 12, the border region (3) having an annular projection (31) protruding radially inward from the border region (3).

14. The pressure relief valve according to claim 1, wherein the at least one through opening (51) is completely arranged outside the first sealing region (21), and wherein the second sealing region (22) surrounds the at least one through opening (51).

15. The pressure relief valve according to claim 1, wherein the first sealing region (21), the second sealing region (22) and the third sealing region (23) are circular and are centered on the central axis of the main body (2).

16. A packaging container comprising at least one pressure relief valve (1), the pressure relief valve (1) having:

a main body (2), at least one through opening (51), which extends through the main body (2), a diaphragm (6), which is arranged over the at least one through opening (51), and a fluid (8), which is provided on the main body (2), the fluid (8) being arranged between the diaphragm (6) and the main body (2), the main body (2) having a first sealing region (21), a second sealing region (22) and a third sealing region (23), the first sealing region (21), the second sealing region (22) and the third sealing region (23) being respectively formed as continuously closed, the second sealing region (22) being arranged radially inside the third sealing region (23), the first sealing region (21) being arranged radially inside the second sealing region (22), the at least one through opening (51) being arranged between the first sealing region (21) and the second sealing region (22), and the diaphragm (6) covering the first sealing region (21), the second sealing region (22) and the third sealing region (23), wherein, starting from a central axis (25) of the main body (2) and viewed along a direction perpendicular to the central axis (25), the at least one through opening (51) is arranged between a radially outer edge of the first sealing region (21) and a radially inner edge of the second sealing region (22), wherein the third sealing region (23) is formed in the form of a cone envelope ring, and wherein the first sealing region (21) and the second sealing region (22) respectively lie in a common sealing plane (E) perpendicular to the central axis (25) of the main body (2).

17. A pressure relief valve embodied free of springs and configured to be fastened on a packaging container, the pressure relief valve comprising:

a main body (2), at least two through openings (51, 52), which extend through the main body (2), a diaphragm (6), which is arranged over the at least two through openings (51, 52), and a fluid (8), which is provided on the main body (2), the fluid (8) being arranged between the diaphragm (6) and the main body (2), and the fluid (8) having the effect that the diaphragm (6) is held on the main body (2) by adhesion, the main body (2) having a first sealing region (21), a second sealing region (22) and a third sealing region (23), the first sealing region (21), the second sealing region (22) and the third sealing region (23) being respectively formed as continuously closed, the second sealing region (22) being arranged radially inside the third sealing region (23), the first sealing region (21) being arranged radially inside the second sealing region (22), the at least two through openings (51, 52) being arranged between the first sealing region (21) and the second sealing region (22), and the diaphragm (6) covering the first sealing region (21), the second sealing region (22) and the third sealing region (23), wherein, starting from a central axis (25) of the main body (2) and viewed along a direction perpendicular to the central axis (25), the at least two through openings (51, 52) each are arranged between a radially outer edge of the first sealing region (21) and a radially inner edge of the second sealing region (22), wherein each of the at least two through openings (51, 52) are completely arranged outside the first sealing region (21), wherein the second sealing region (22) surrounds both of the at least two through openings (51, 52), wherein the third sealing region (23) is formed in the form of a cone envelope ring, and wherein a first depression (41) is formed in the main body (2) between the first sealing region (21) and the second sealing region (22), and wherein the at least two through openings (51, 52) are respectively arranged between the first sealing region (21) and the second sealing region (22) and respectively open out into the first depression (41).

18. The pressure relief valve according to claim 17, wherein the at least two through openings (51, 52) are formed eccentrically and symmetrically in relation to the central axis (25) of the main body (2).

19. A pressure relief valve configured to be fastened on a packaging container, the pressure relief valve comprising:

a main body (2), at least one through opening (51), which extends through the main body (2), a diaphragm (6), which is arranged over the at least one through opening (51), and a fluid (8), which is a silicone oil and is provided on the main body (2), the fluid (8) being arranged between the diaphragm (6) and the main body (2), and the fluid (8) having the effect that the diaphragm (6) is held on the main body (2) by adhesion, the main body (2) having a first sealing region (21), a second sealing region (22) and a third sealing region (23), the first sealing region (21), the second sealing region (22) and the third sealing region (23) being respectively formed as continuously closed, the second sealing region (22) being arranged radially inside the third sealing region (23), the first sealing region (21) being arranged radially inside the second sealing region (22), the at least one through opening (51) being arranged between the first sealing region (21) and the second sealing region (22), and the diaphragm (6) covering the first sealing region (21), the second sealing region (22) and the third sealing region (23), wherein, starting from a central axis (25) of the main body (2) and viewed along a direction perpendicular to the central axis (25), the at least one through opening (51) is arranged between a radially outer edge of the first sealing region (21) and a radially inner edge of the second sealing region (22), and wherein the third sealing region (23) is formed in the form of a cone envelope ring, and wherein the first sealing region (21) and the second sealing region (22) respectively lie in a common sealing plane (E) perpendicular to the central axis (25) of the main body (2).

* * * * *